US005595521A

United States Patent [19]

Becker

[11] Patent Number: 5,595,521

[45] **Date of Patent: *Jan. 21, 1997**

[54] BALLOONS AND BALLOON VALVES

[75] Inventor: Charles R. Becker, Chicago, Ill.

[73] Assignee: M & D Balloons, Inc., Manteno, Ill.

[ * ] Notice: The term of this patent shall not extend beyond the expiration date of Pat. No. 5,482,492.

[21] Appl. No.: 475,422

[22] Filed: Jun. 7, 1995

Related U.S. Application Data

[63] Continuation of Ser. No. 179,308, Jan. 10, 1994, Pat. No. 5,482,492.

[51] Int. Cl.[6] ..... A63H 3/06

[52] U.S. Cl. ..... 446/224; 383/44

[58] Field of Search ..... 446/220–226; 383/3, 44, 47; 138/109, 128, 118, 120, 119, 103

[56] References Cited

U.S. PATENT DOCUMENTS

| | | | |
|---|---|---|---|
| 31,614 | 3/1861 | Mayall . | |
| 279,451 | 6/1883 | Sinclair . | |
| 1,151,093 | 8/1915 | Du Bois . | |
| 1,625,394 | 4/1927 | Roberts . | |
| 1,702,974 | 2/1929 | MacDonald . | |
| 1,881,916 | 10/1932 | Parker . | |
| 1,885,917 | 11/1932 | Kelemen et al. . | |
| 2,597,924 | 5/1952 | Davenport et al. | 2/267 |
| 2,662,724 | 12/1953 | Kravagna | 251/122 |
| 2,700,980 | 2/1955 | Andrews | 137/223 |
| 2,713,746 | 7/1955 | Haugh | 46/87 |
| 2,954,048 | 9/1960 | Rychlik | 137/512.15 |
| 3,006,257 | 10/1961 | Orsini | 93/35 |
| 3,133,696 | 5/1964 | Mirando | 230/160 |
| 3,230,663 | 1/1966 | Shabram | 46/90 |
| 3,295,556 | 1/1967 | Gertsma et al. . | |
| 3,332,415 | 7/1967 | Ericson | 128/87 |
| 3,384,294 | 5/1968 | Astle . | |
| 3,523,563 | 8/1970 | Mirando | 141/313 |
| 3,664,058 | 5/1972 | Brieske | 46/90 |
| 3,717,174 | 2/1973 | Dewall | 137/565 |
| 3,759,289 | 9/1973 | DeWall | 137/525 |
| 4,077,588 | 3/1978 | Hurst | 244/31 |
| 4,110,144 | 8/1978 | Buehler et al. | 138/109 |
| 4,127,909 | 12/1978 | Pizzo | 9/11 A |
| 4,674,532 | 6/1987 | Koyanagi | 137/512.15 |
| 4,708,167 | 11/1987 | Koyanagi | 137/512.15 |
| 4,758,198 | 7/1988 | Ishiwa | 446/220 |
| 4,842,007 | 6/1989 | Kurtz | 137/223 |
| 4,850,912 | 7/1989 | Koyanagi | 441/40 |
| 4,872,558 | 10/1989 | Pharo | 383/3 |
| 4,917,646 | 4/1990 | Kieves | 446/224 |
| 4,949,756 | 8/1990 | Melinyshyn et al. | 137/846 |
| 4,983,138 | 1/1991 | McGrath | 446/224 |
| 5,108,339 | 4/1992 | Kieves | 446/224 |
| 5,121,996 | 6/1992 | Scarrow . | |
| 5,188,558 | 2/1993 | Barton et al. | 446/224 |
| 5,248,275 | 9/1993 | McGrath et al. | 446/224 |

FOREIGN PATENT DOCUMENTS

| | | |
|---|---|---|
| 52-11898 | 4/1977 | Japan . |
| 53-144579 | 10/1978 | Japan . |

OTHER PUBLICATIONS

Exhibit A —Photocopy of Nonlatex Balloon by CTI Corporation of Barrington, Illinois, undated (2 sheets).

Exhibit B —Photocopy of Nonlatex Balloon by Classic Balloon Corporation, Carrollton, Texas, undated.

Exhibit C —one sheet of drawings of Exhibit A labeled FIGS. 1–8 and one sheet of drawings of Exhibit B labeled FIGS. 9–16.

*Primary Examiner*—Robert A. Hafer
*Assistant Examiner*—Jeffrey D. Carlson
*Attorney, Agent, or Firm*—Fitch, Even, Tabin & Flannery

[57] ABSTRACT

Balloon assemblies and valves for balloons have improved inflation capabilities. The inlet ends of the balloon valves are disrupted either with a slit or a portion of material removal to prevent the inlet end from being folded back into the valve passageway during insertion of an inflation probe. With the inlet end slit, the slit portions are readily folded back by the inflation probe, thus preventing potential blockage of the valve inlet.

27 Claims, 8 Drawing Sheets

Fig. 23 (Prior Art)
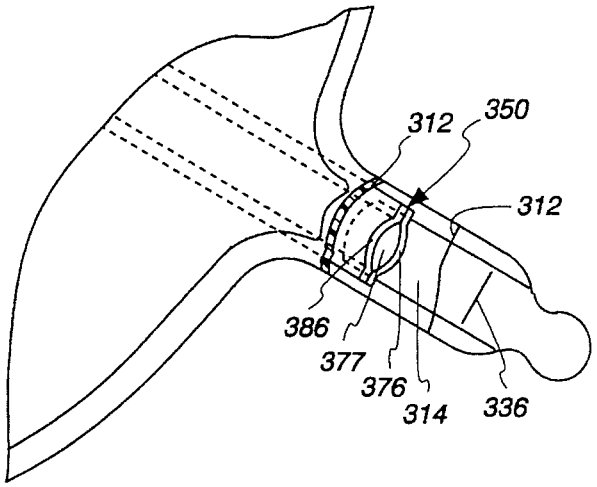
Fig. 24 (Prior Art)
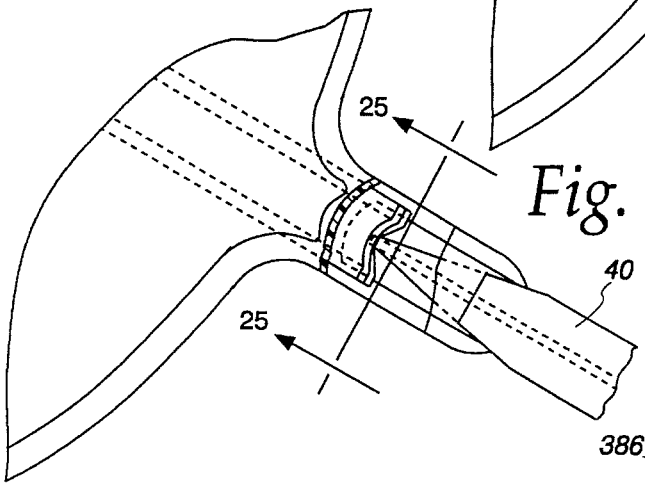
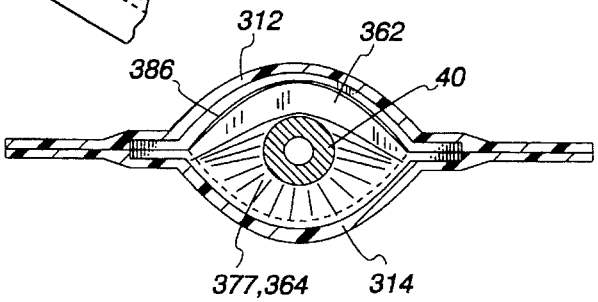
Fig. 25 (Prior Art)
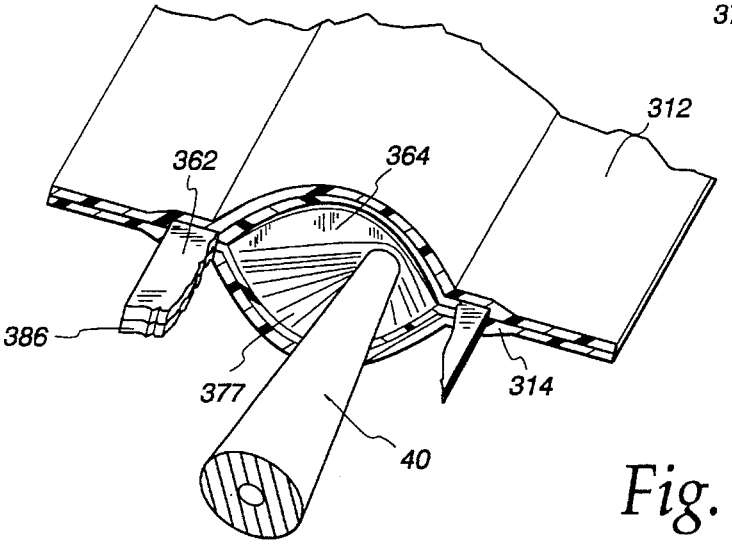
Fig. 26 (Prior Art)
Fig. 27
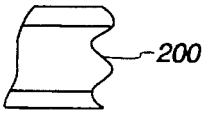
Fig. 28
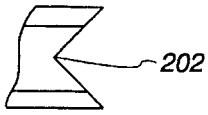
Fig. 29
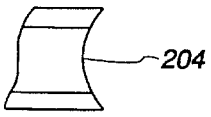

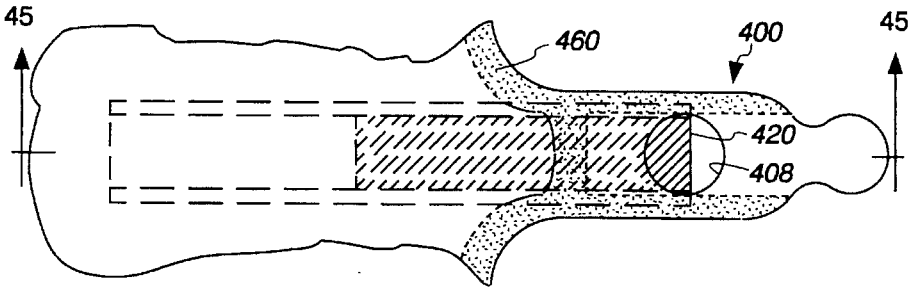
Fig. 38
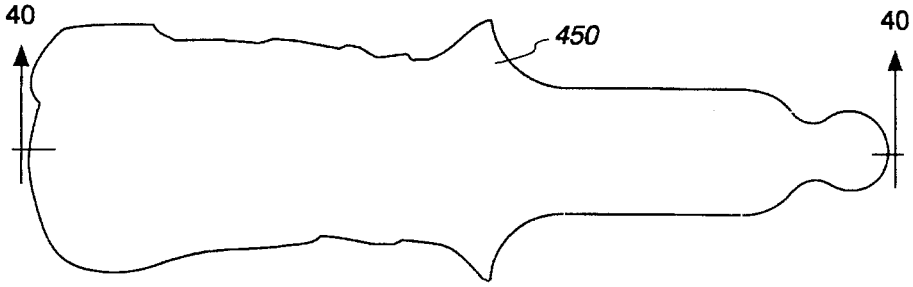
Fig. 39
Fig. 40
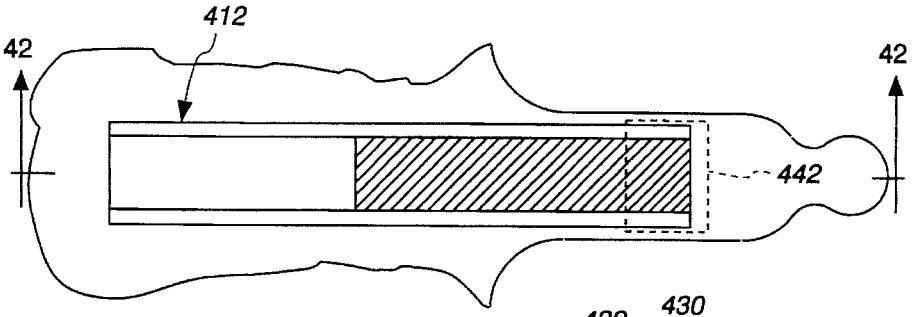
Fig. 41
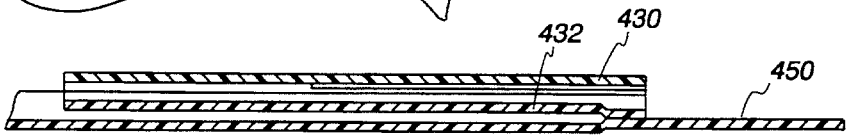
Fig. 42
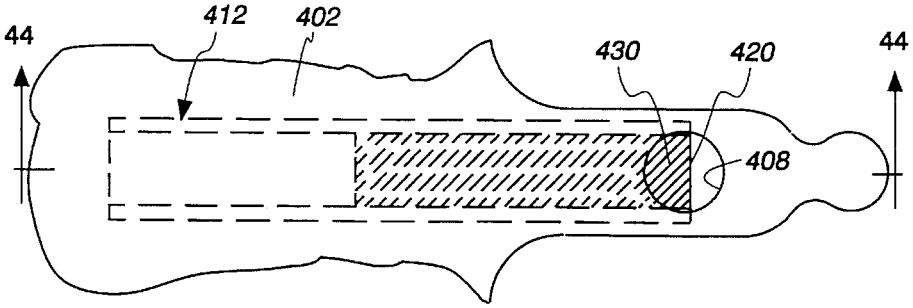
Fig. 43
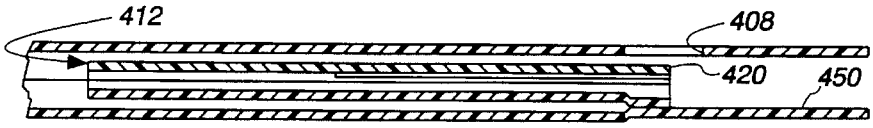
Fig. 44
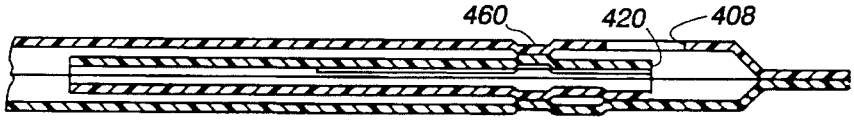
Fig. 45

BALLOONS AND BALLOON VALVES

CROSS-REFERENCE TO RELATED APPLICATIONS

This is a continuation of U.S. patent application Ser. No. 08/179,308, filed Jan. 10, 1994, U.S. Pat. No. 5,482,492.

BACKGROUND OF THE INVENTION

1. Field of the Invention

The present invention pertains to balloons, and in particular to valves for use with balloons.

2. Description of the Related Art

Many of the balloons being sold today, especially toy balloons, are of the self-sealing type, having a valve made by overlapping two layers of valve film to form a collapsible hollow tube when inflated. The valves are used to introduce an inflating gas into the balloon interior. When the balloon is inflated, the internal pressure within the balloon compresses the valve films together, closing off the hollow interior of the tube, thus preventing pressure loss from the balloon interior.

In order to optimize sealing of the valve tube under pressure, the valve film physical properties are usually different from those of the balloon film. For example, compared to metalized balloon films in popular use today, valve films are typically "softer" and are more susceptible to stretching. It has been observed, from time to time, upon insertion of an inflation probe in the balloon valve, that edges of the valve film at the valve inlet may be pushed by the probe into the valve interior. The valve films in use today, especially in toy balloons, can be made to stretch if placed under tension, and it is important that edges of the valve film are not allowed to conform to the probe tip, so as to be stretched within the valve passageway by the probe, thus impairing the inflation operation. It has been found cost effective for distributors of balloons to make the balloons available to a wide variety of businesses not involved with the manufacture and assembly of objects. It is appealing, given present channels of trade, to provide a balloon product which is trouble-free in operation, even by those who are unfamiliar with manufacturing or assembly operations.

SUMMARY OF THE INVENTION

It is an object according to principles of the present invention to provide an improved valve for use with balloons.

Another object according to principles of the present invention is to provide an improved valve with so-called "coterminous," i.e., edges formed by two overlapping layers of valve film which are even with one another.

A further object according to principles of the present invention is to provide an improved valve of the above type which may be inexpensively produced by modifying existing valves with minimal cost.

These and other objects according to principles of the present invention, which will become apparent from studying the appended description and drawings, are provided in a valve for use in a balloon filled with a pressurized gas, comprising:

first and second layers of flexible valve material disposed in at least partially overlapping relationship;

means for joining said first and said second layers together to form a double-ended hollow tube for passage of the pressurized gas therethrough, with the tube having an inlet end and an outlet end; and at least one of said first and said second layers having an inlet end at the inlet end of the tube, which is divided into at least two unconnected parts.

BRIEF DESCRIPTION OF THE DRAWINGS

FIG. 23 is a fragmentary perspective view, shown partly broken away, of the prior art balloon and valve assembly of FIG. 19.

FIG. 24 is a view similar to that of FIG. 23 showing the inflation probe inserted in the valve.

FIG. 25 is a cross-sectional view taken along the line 25—25 of FIG. 24.

FIG. 26 is a perspective view thereof.

FIGS. 27–29 are fragmentary perspective views of alternative valve assemblies.

FIG. 38 is a fragmentary top plan view of another balloon assembly illustrating principles of the present invention.

FIG. 39 is a fragmentary bottom plan view thereof.

FIG. 40 is a fragmentary cross-sectional view taken along the line 40—40 of FIG. 39.

FIG. 41 is a top plan view similar to that of FIG. 39 but showing a valve member installed.

FIG. 42 is a fragmentary cross-sectional view taken along the line 42—42 of FIG. 41.

FIG. 43 is a fragmentary top plan view of the balloon assembly with the upper balloon film installed.

FIG. 44 is a fragmentary cross-sectional view taken along the line 44—44 of FIG. 43.

FIG. 45 is a fragmentary cross-sectional view taken along the line 45—45 of FIG. 38.

DETAILED DESCRIPTION OF THE PREFERRED EMBODIMENTS

Figure 1:
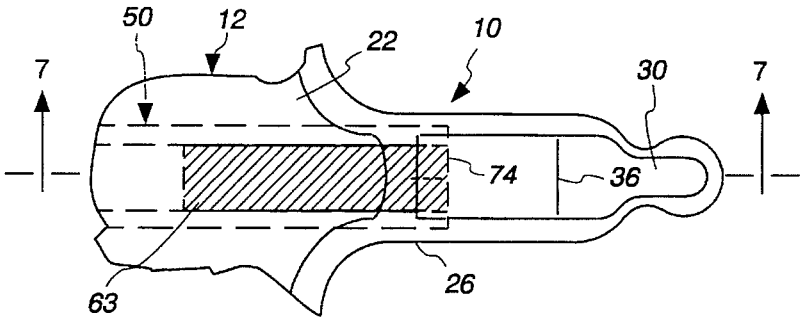
FIG. 1 is a fragmentary top plan view, shown partly cut away, of a balloon and valve assembly illustrating principles according to the present invention.

Referring now to the drawings, and initially to FIGS. 1–6, a balloon and valve assembly illustrating principles according to the present invention is generally indicated at 10. Assembly 10 has found immediate commercial acceptance for use as a toy balloon, although the present invention is also applicable to other inflated structures, such as hot water bottles, weather balloons inflatable bladders and air mattresses, for example. Assembly 10 is comprised of four layers, as seen, for example, in FIGS. 7 and 8. The two outer layers of the balloon are substantially identical, being coextensive with one another.

The outer layers or balloon films 12, 14 are made of conventional "balloon film" which covers a wide variety of plastics materials in commercial use today, including metalized balloon films having a plastics substrate. The balloon films 12, 14 include body portions 22, 24, neck portions 26, 28 and tether portions 30, 32 for tying a string, ribbon or other tethered device to the inflated balloon. The upper balloon film 12 further includes a slit or other opening 36 formed in neck portion 26, for insertion of an inflation probe which can have a wide variety of shapes. As shown in the drawings, inflation probe 40 has a conical tip 42 and a central hollow passageway 44 for passage of pressurized inflating gas.

Figure 7:
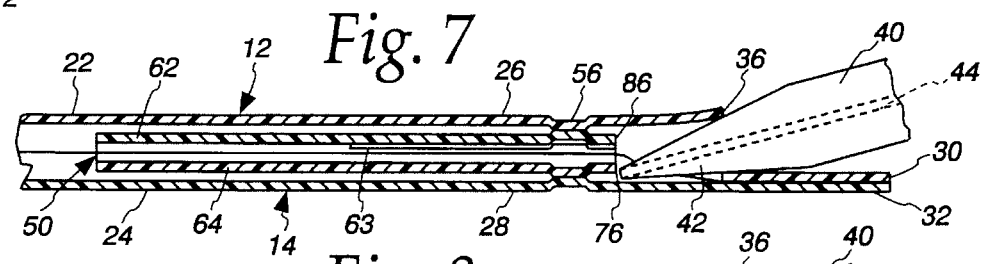
FIG. 7 is a cross-sectional view taken along the line 7—7 of FIG. 1, shown at an early stage of probe insertion.
Figure 8:
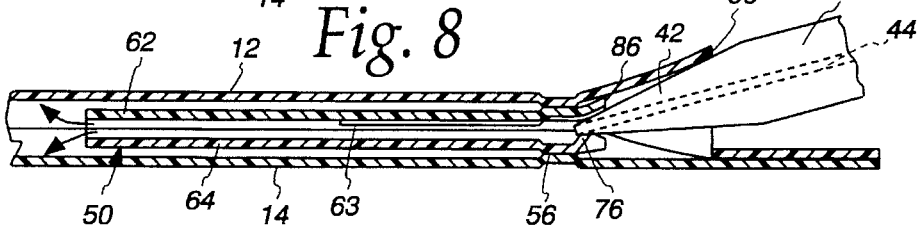
FIG. 8 is a view similar to that of FIG. 7 showing the probe at a later stage of insertion.

A valve generally indicated at 50 is inserted between the balloon films 12, 14 and is sealed thereto by heat and pressure. For example, referring to FIG. 3, the regions of heat sealing resemble an "H-shape"0 in appearance. Included are heat-sealing portions 54 sealing the periphery of the balloon films 12, 14 together, a valve seal region 56 (located at the crossbar of the H-shape) bonding the four layers of assembly 10 in pairs, as shown in FIGS. 7 and 8. Also included is a neck seal portion 58 bonding the balloon films 12, 14 together to finish the balloon construction, and to reinforce the neck portion weakened by slit 36.

Figure 2:
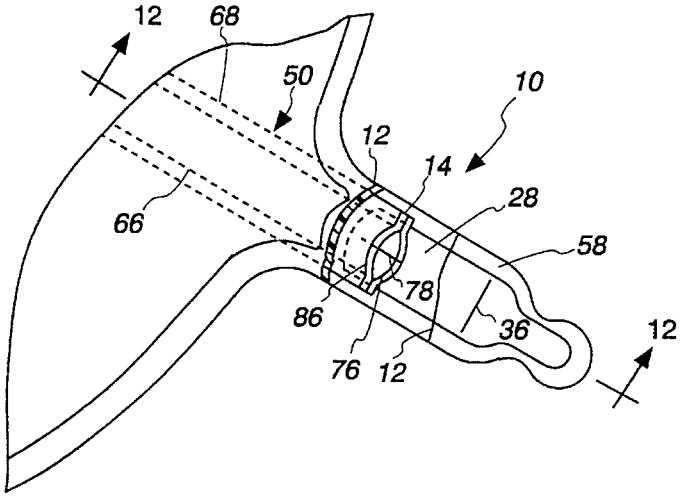
FIG. 2 is a fragmentary perspective view thereof.

The valve 50 is comprised of upper and lower, generally coextensive valve film layers 62, 64 which are shown in FIG. 7. As can be seen in FIG. 2, for example, these layers are elongated in a direction generally toward the center of the balloon films. The valve films 62, 64 are bonded together at their longitudinally extending edges by bands 66, 68 of sealing, preferably thermal bonding. Although not necessary, it is generally preferred that the valve layers be bonded together prior to the construction of the balloon assembly.

In the preferred embodiment, the valve 50 is inserted between balloon film layers 12, 14 and is bonded to the balloon films by the same operation which seals the marginal edges of the balloon films. As shown in FIGS. 1 and 2, for example, in a single step the various layers of assembly 10 are bonded together with heated dies conforming to the outer periphery of the balloon films (including heat-sealing portions 54, 58), as well as the cross sealing or valve seal 56 at the center of the "H" pattern. The sealing pattern can be clearly seen in the fragmentary view of FIG. 6, which shows the bottom balloon film 14. In the preferred embodiment, the balloon film 14 is a flat sheet without deformations or other surface structures. Interior lines shown in FIG. 6 result from the thermal-fusion of the valve layers, and do not arise from any structures formed in the balloon film. For clarity of description and illustration, the portions of thermal-fusion sealing are shown stippled in FIG. 6. Preferably, thermal joining is accomplished by a heated die having a shape conforming to the stippled portions of FIG. 6, which simultaneously presses the layers of the balloon and valve assembly together. Of course, other types of construction are possible, including the thermal joining of various layers to one another either in one step or a series of multiple steps. If desired, ultrasonic welding or impulse sealing techniques can also be employed to join the films together.

Figure 5:
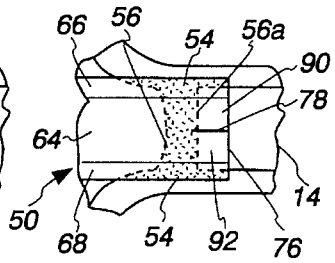
Figure 6:
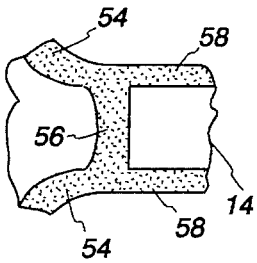

The preferred valve film layers 62, 64 are substantially identical to one another and, as shown in the drawings, have generally rectangular configurations. As shown in FIG. 1, the right hand end 74 of valve 50 is the inlet end of the valve, lying within the neck of the balloon. FIG. 5 shows the inlet edge 76 of the lower valve film 64 and the bottom balloon film layer 14. As mentioned, the valve is preferably preassembled, with the valve film layers bonded together at their marginal edges 66, 68, prior to the joining of the four balloon layers, as will be described herein. In FIG. 5, the sealed area of overlap of the bottom valve film layer 64 and the valve 50 is indicated by stippling for purposes of description. Throughout the stippled area of FIG. 5, the valve and balloon films are continuously bonded together to form a pressure-tight leak-proof seal between them. As seen in FIG. 5, relatively small lateral portions of the valve films are sealed to the balloon films by the balloon-seal and neck seal at the periphery of the balloon, a preferred quality assurance measure to prevent leakage.

Figure 4:
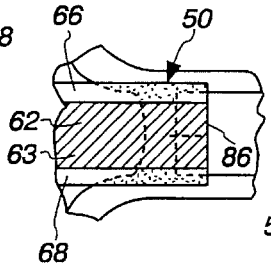

FIG. 4 shows the additional layer 62, the top layer of valve 50, being added to the structure of FIGS. 5 an 6. The inlet end 86 of upper valve film layer 62, as illustrated in the preferred embodiment of FIG. 4, is generally coterminous, or even with the inlet edge 76 shown in FIG. 5. Except for a slit 78 (to be described later), the layers 62, 64 of valve 50 are generally identical to one another. The portion of bonding to the underlying layers 64 and 14 is indicated by stippling in FIG. 4. The central passageway of valve 50, that is, the portion lying between marginal bands 66, 68, remains unattached to the lying layers 64, 14. However, the upper valve film layer 62 is bonded to the overlying balloon film layer 12 with a bonding pattern resembling that indicated by stippling in FIG. 5.

Preferably, one of the valve film layers is coated with a heat-resistant ink or other non-sealable coating on one or both of its opposed inner surfaces to prevent bonding during balloon manufacture, without requiring the use of temporary insertion of a heat-resistant barrier or the like during forming of the balloon seal. In the preferred embodiment, the upper valve film layer 62 is coated with a heat-resistant ink 63, indicated in FIGS. 1–9 with a hatch pattern. The ink coating 63 is applied to the bottom surface of upper valve layer 62, as shown, for example, in FIGS. 7 and 8. It is important that the heat-resistant ink 63 be applied in the region of bonding portion 56 to prevent unintentional valve closure during balloon manufacture. As shown in FIG. 5, the inlet portion of lower valve layer 64 is bounded on three sides by bonding formed during the balloon manufacture process. This inlet portion is divided by slit 78 into tabs 90, 92, which are independently movable, one with respect to the other, so as to clear a path for inflation probe 40, as will be seen herein. According to one aspect of the present invention, a slit 78 extends from the inlet edge 76, into the valve sealing area 56, as shown in FIG. 5. The slit could also terminate at a point adjacent the valve sealing portion 56, short of the sealing area 56, for example.

Heat-resistant ink employed in the preferred embodiment of valve 50 does not play a role in the stippled area illustrated in FIG. 5, which indicates bonding of the outside surface of the valve to an inner surface of a balloon film. The end portions of the valve films are formed essentially by the relative location of the valve with respect to the balloon films, that is, with respect to the heat seals.

Commercially viable production techniques are able to provide a high degree of accuracy in the registration of the valve films (and also in the registration of the balloon films) without incurring prohibitive cost penalties. However, in developing techniques for the economical assembly of a completed balloon, it has been found that placement of the valve relative to the balloon films can be held to fairly close tolerances, but still, throughout a production run, some completed balloons are observed to have less than ideal alignment of the valve with respect to the balloon films. An ideal alignment would consistently place the free edges of the valve films, such as the free edge 76 shown in FIG. 5 at the bottom edge 56A of valve seals 56. However, as will now be appreciated, the valve must completely cover the crossbar of the "H" pattern shown in FIG. 6, to prevent bonding of the balloon films together at that location, thus preventing entry into the interior cavity of the balloon. Accordingly, in commercially practicable mass production of balloons, a small amount of the valve is made to extend beyond the valve seal 56.

As shown in FIG. 5, the inlet portion of the lower valve layer 64, located adjacent inlet edge 76, is bounded on three sides by bonding formed during the balloon manufacture process. Throughout a sustained production run, the edge 76 of the valve film will be located at varied distances with respect to the bottom edge 56A of valve seal 56. While it may theoretically be possible to reduce distances between free edge 76 and edge 56A beyond that already attained using prohibitively expensive equipment and labor intensive techniques, economic manufacture of the balloons has prevented such efforts. According to one aspect of the present invention, the valve inlet portion is divided by slit 78 into tabs 90, 92, which are unconnected at their adjacent edges and hingeable at other portions by reason of the flexible nature of the valve film material, so as to be independently movable, one with respect to the other, so as to clear a path for inflation probe 40. With practice of the present invention to divide the valve inlet portion, deleterious effects associated with substantial distances between free edge 76 and edge 56A can be avoided.

Figure 3:
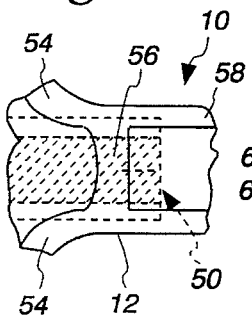
FIGS. 3–6 are fragmentary views thereof with successive layers removed.

The present invention helps to insure the formation of a continuous tubular passageway which extends from the neck of the balloon to the balloon interior, passing through the sealing area shown in FIGS. 1 and 3. Prior to inflation, the tubular passageway of valve 50 is collapsed, but is readily opened upon introduction of a pressurized gas therein, to assume the opened hollow center shown in FIG. 2. Referring to FIG. 7, the tip 42 of inflation probe 40 is inserted through slit 36, between the balloon film layers 12, 14, in the manner indicated in FIG. 7. As will now be appreciated, this is a "blind" operation, and it is not possible for an operator to see the alignment of the probe tip with the valve inlet edges. Experience has indicated that operators of the valve inflating equipment drag the probe across the bottom balloon layer 14, within the neck portion of the balloon, preparatory to aligning the inflation tip with the inlet edges of the valve. The present invention overcomes a problem which has been encountered in prior art balloon assemblies, which will now be described with reference to FIGS. 19–26.

Referring now to FIGS. 19–26, a prior art balloon assembly is generally indicated at 310 and has upper and lower valve film layers 312, 314 on either side of a conventional valve 350. The valve 350 is similar to the valve 50 of the present invention, except that the inlet edges 386, 376 of the upper and lower valve layers 362, 364 are unbroken, and are coterminous with one another. Probe 40 is shown inserted in slit 336, lying within the balloon neck in preparation for inflation of the balloon. When the tip of probe 40 is dragged across the bottom balloon layer 314 and then raised slightly for entrance to the valve inlet, the bottom flap 377 (formed between the bonding portion 356 and free edge 376) is "kicked up", at least partly obstructing the inlet to valve 350. Probe insertion is shown in greater detail in FIG. 24. Many types of valve film materials in use today will stretch a considerable amount when placed under tension. This tendency for stretching is shown in FIG. 25 with tab 377 stretched to fill a substantial portion of the valve inlet and, as shown in FIG. 26, may partially block the tip of inflation probe 40.

With reference to FIG. 8, it is possible that the inlet edge 76 of the bottom valve layer 64 may also be "kicked up." Because of slit 78, however, it is unlikely that the valve inlet would become obstructed by this displacement of the valve film by the tip of the inflation probe.

Figure 9:
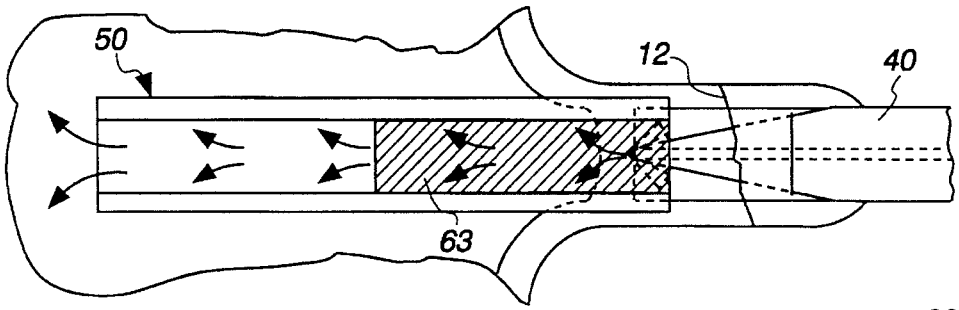
FIG. 9 is a top plan view similar to that of FIG. 1 showing the probe inserted.
Figure 10:
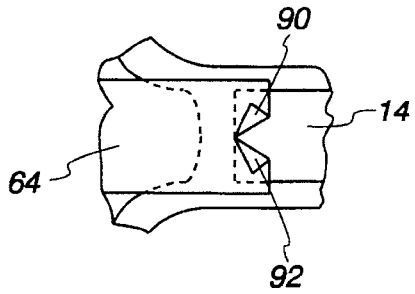
FIG. 10 is a fragmentary top plan view similar to that of FIG. 5, but shown during probe insertion.
Figure 11:
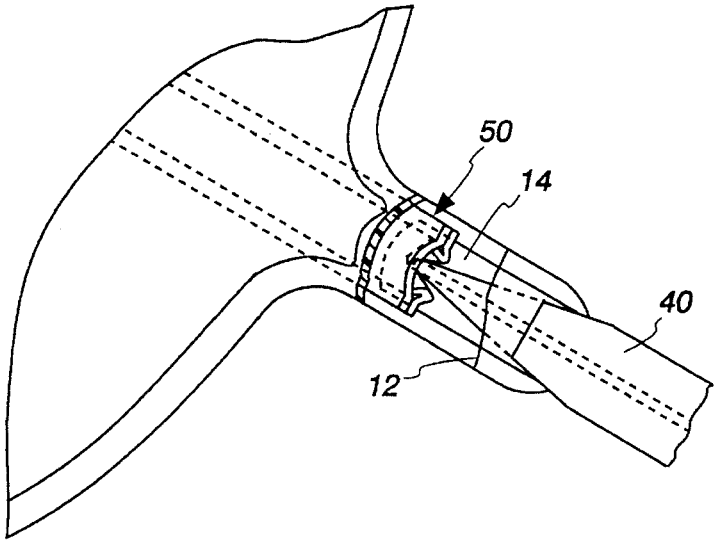
FIG. 11 is a perspective view similar to that of FIG. 2, but showing the probe inserted.
Figure 12:
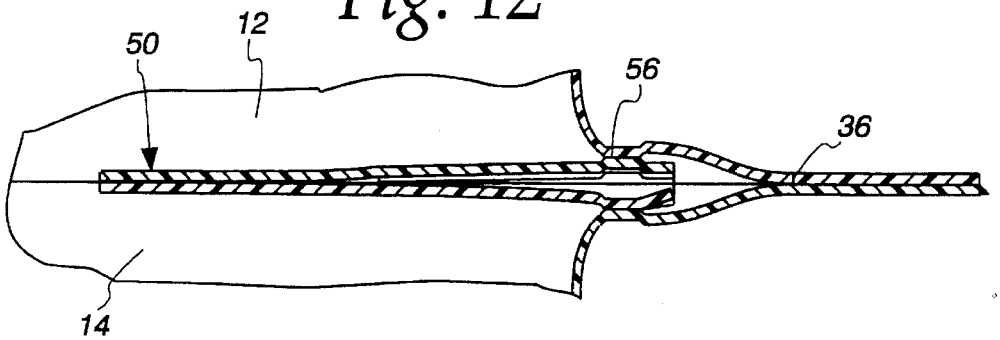
FIG. 12 is a cross-sectional view taken along the line 12—12 of FIG. 2, but shown after inflation.

Referring again to FIG. 5, it will now be appreciated that slit 78 forms two tabs 90, 92 at the inlet edge of the bottom valve film 64. In particular, free edge 76 is split into two unconnected and separate, preferably independently movable portions which are bent or folded out of the way of inflation probe 40, as illustrated in FIGS. 9–11. FIG. 10 is a view similar to that of FIG. 5, that is, showing only the bottom balloon film layer 14 and bottom valve layer 64, during probe insertion. With a single slit 78 or a notch or other cut formed at the inlet edge of the lower valve film, insertion of probe 40 (in the manner indicated in FIGS. 7 and 8) will push back tabs 90, 92 at their mating edges (formed by slit 78) into two hinged, flexible triangular flaps.

Figure 13:
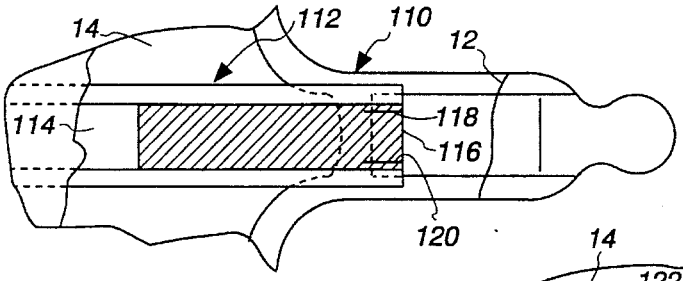
FIGS. 13–15 are fragmentary top plan views of an alternative embodiment of balloon and valve assemblies illustrating principles of the present invention.

Other arrangements for improving the valve inlet are illustrated in FIGS. 13–18. Referring now to FIG. 13, an alternative embodiment of a balloon and valve assembly according to principles of the present invention is generally indicated at 110. A valve 112 constructed according to principles of the present invention has an upper valve film layer 114 with an inlet end 116. Slits 118, 120 extend from the inlet edge 116 into a region of thermal bonding, as described above. The bottom layer of valve 112 is substantially the same as the upper valve layer 163 and is substantially identical to the valve layer 114, except for the omission of slits 118, 120. In valve assembly 110 the slits in the inlet end of the valve are formed in the upper valve layer. If desired, valve 112 could be inverted so that valve layer 114, with slits 118, 120, is on the lower layer of the valve, immediately adjacent the lower balloon layer. Accordingly, as with the first-described embodiment, valve assembly 110 can have its valve member with inlet-disrupting slits formed in either the upper valve layer, the lower valve layer or both valve layers.

If desired, the slit 78 could extend through the upper valve layer 62, as well.

As in the preceding embodiment, the slits 118, 120 could extend through both valve layers, if desired. Alternatively, the centrally located slit 78 could be formed in the bottom layer of valve 112, with slits 118, 120 formed in the upper valve layer.

Figure 14:
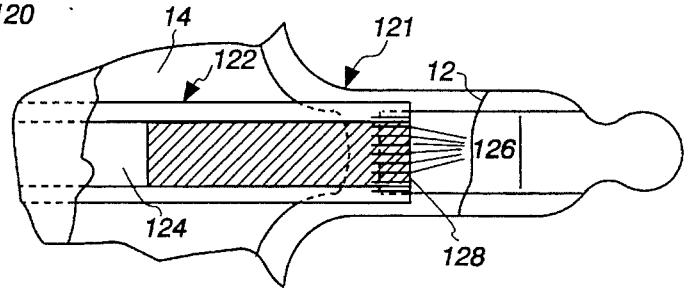

In FIG. 14, a balloon 120 has a valve 122 with an upper layer 124 having a plurality of slits 126 formed at the inlet end 128.

Figure 15:
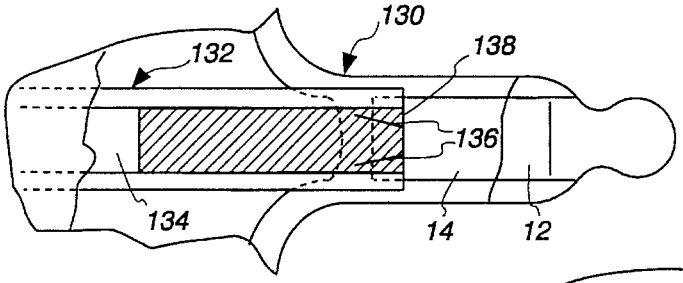

In FIG. 15, a balloon 130 has a valve 132 having an upper layer 134 with non-parallel slits 136 formed at its inlet end 138.

Figure 16:
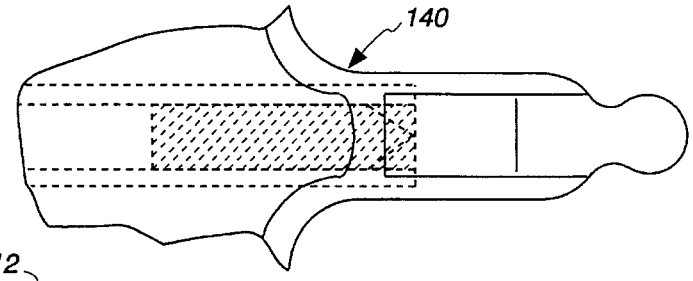
FIGS. 16–18 are top plan views of balloon and valve assemblies showing further alternative embodiments according to principles of the present invention.
Figure 17:
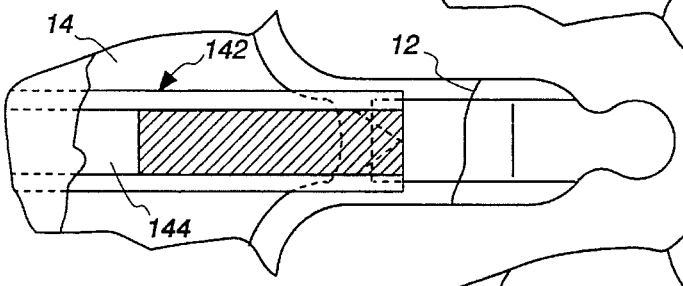
Figure 18:
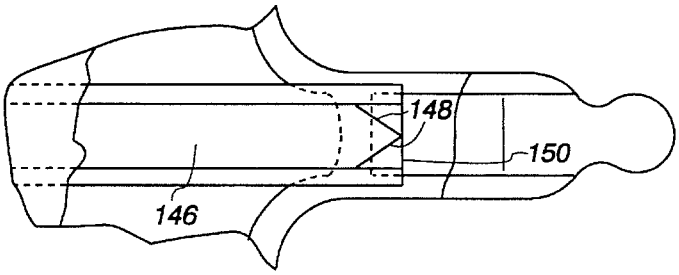
Figure 19:
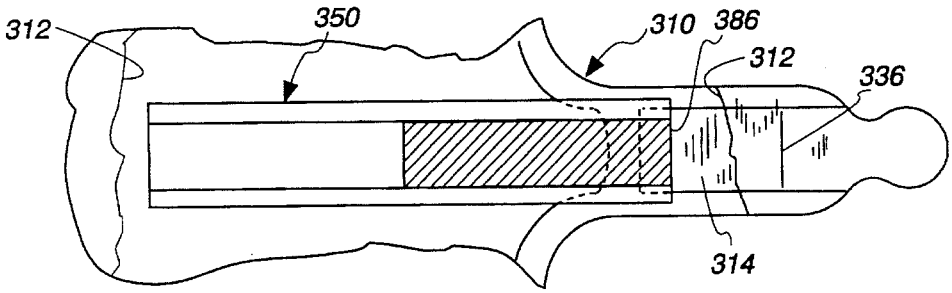
Fig. 19 (Prior Art)
FIG. 19 is a fragmentary top plan view, shown partly broken away, of a prior art balloon and valve assembly.
Figure 20:
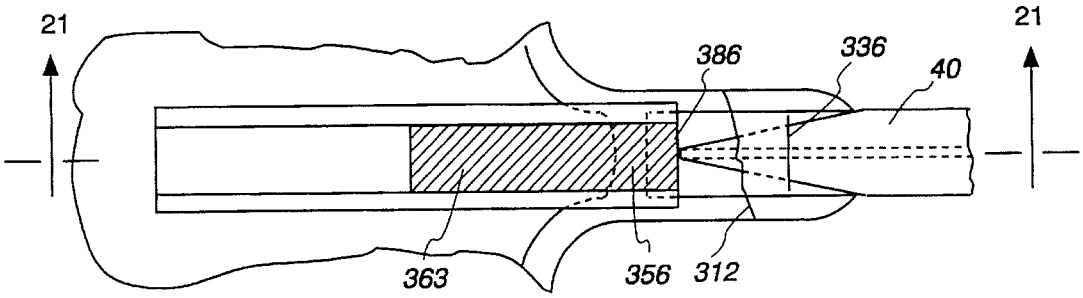
Fig. 20 (Prior Art)
FIG. 20 is a top plan view thereof showing an inflation probe at an early stage of insertion.
Figure 21:
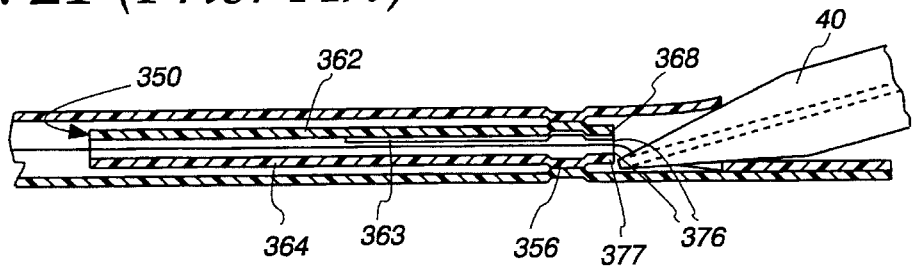
Fig. 21 (Prior Art)
FIG. 21 is a fragmentary cross-sectional view taken along the line 21—21 of FIG. 20.
Figure 22:
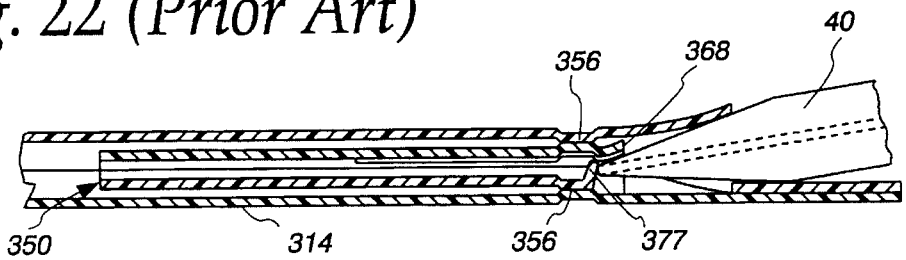
Fig. 22 (Prior Art)
FIG. 22 is a view similar to that of FIG. 21 showing the inflation probe at a later stage of insertion.

In FIGS. 16–18, a balloon 140 has a valve 142 with a generally rectangular unbroken upper layer 144 and a lower layer 146 with converging slits 148 formed at its inlet end 150. As shown in FIGS. 16–18, the slits 148 meet at the inlet edge 150, and thus show one example of intersecting slits.

Other variations are, of course, possible. For example, the slits illustrated herein follow a generally straight line. However, the slits could be sinuous or arcuate or, as a further alternative, could be variegated, as formed with a pinking shears, for example. In the embodiments shown above, the valve layer, which has been disrupted at its inlet end by slits, does not have material removed from the inlet end. FIGS. 27–29 show further alternative embodiments of valve film layers, having inlet ends 200–204 formed according to principles of the present invention, by removing portions from a rectangular valve blank. The valve layers are shown with bonding portions at their marginal edges.

As a further alternative, valve inlet features according to principles of the present invention can be incorporated in so-called "noncoterminous" valves. These valves have overlapping valve layers which are not coextensive, wherein the inlet end of one valve layer extends beyond the inlet end of the other valve layer.

Figure 30:
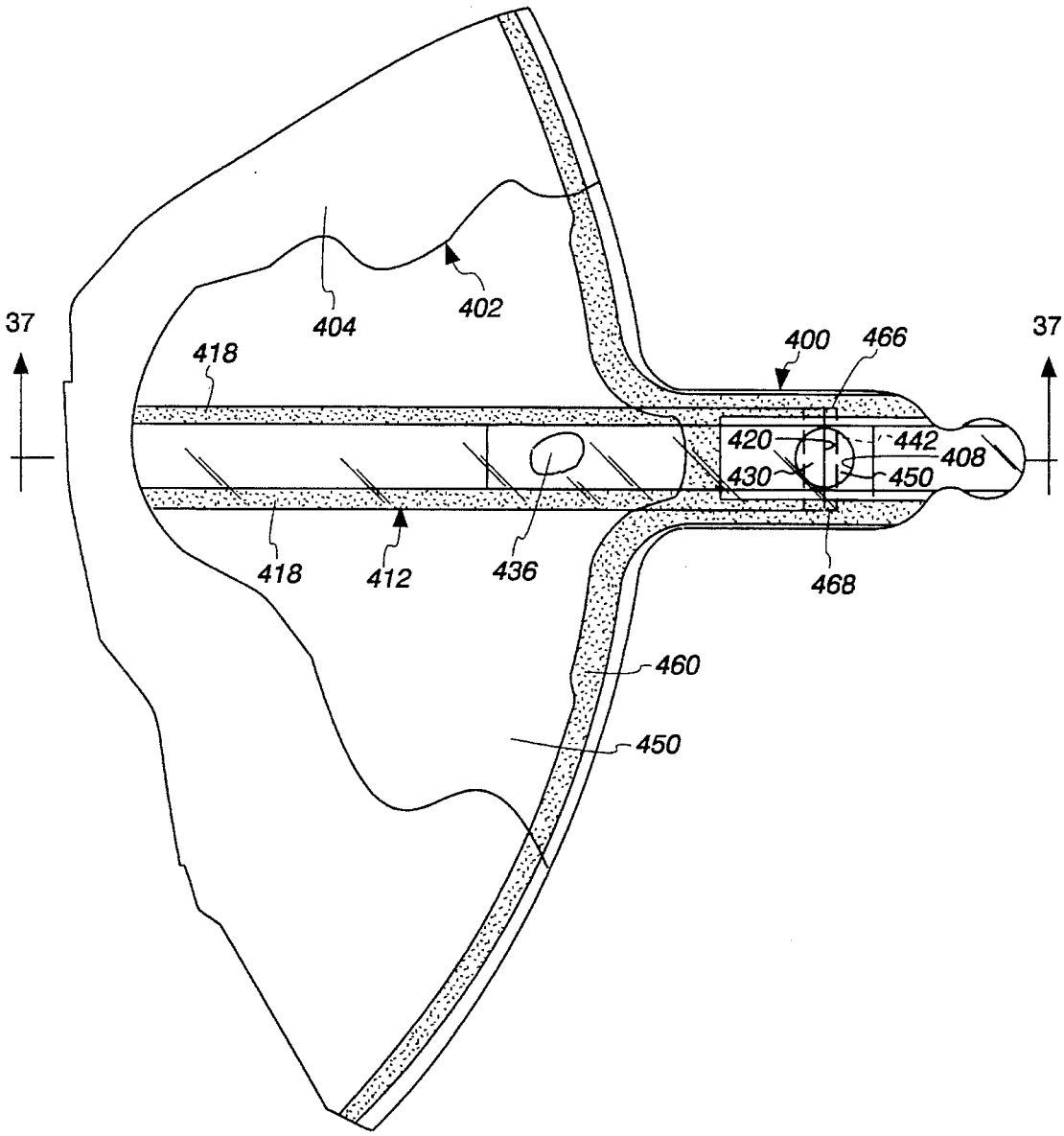
FIG. 30 is a fragmentary top plan view of a further embodiment of a balloon assembly according to principles of the present invention.
Figure 31:
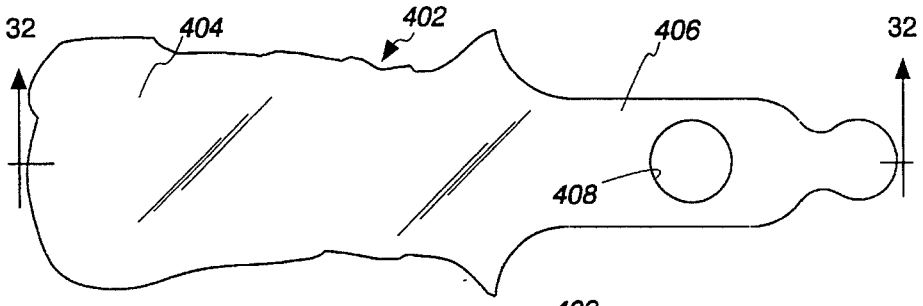
FIG. 31 is a fragmentary top plan view of the upper layer thereof.
Figure 32:
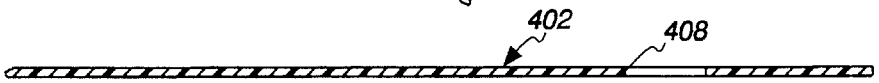
FIG. 32 is a fragmentary cross-sectional view taken along the line 32—32 of FIG. 31.

Turning now to FIGS. 30–37, and initially to FIG. 30, a balloon assembly is generally indicated at 400. As with the preceding embodiments, balloon assembly 400 provides substantial advantages in providing trouble-free inflation of the balloon. If desired, embodiments of the divided balloon inlet construction described above could be incorporated with balloon 400. Further, balloon 400 is suitable with so-called "coterminous" and "noncoterminous" valves. Referring additionally to FIG. 31, balloon 400 includes an upper balloon film 402 having a body portion 404 and a neck portion 406. As shown in FIG. 31, the upper balloon film 402 has a hole 408 formed therein by punching or other suitable means. As shown in the Figures, hole 408 is circular, although the hole can take on virtually any shape as may be desired. A bottom balloon film layer 450 having balloon body and neck portions 452, 454, respectively, is bonded to the aforedescribed layers of balloon 400 (see FIG. 37).

Figure 33:
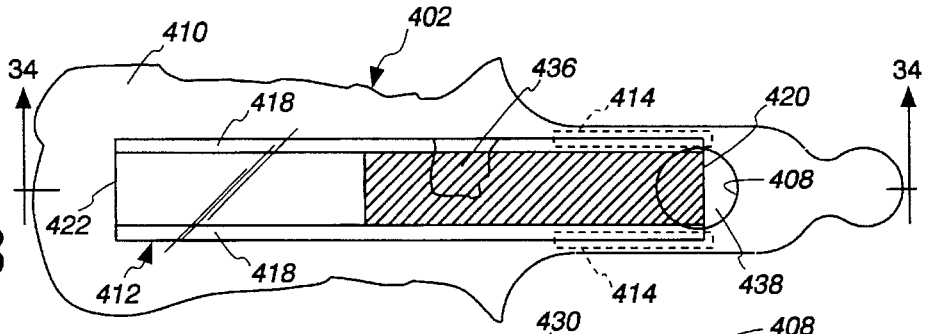
FIG. 33 is a fragmentary bottom plan view similar to that of FIG. 31 but showing a valve member installed.
Figure 34:
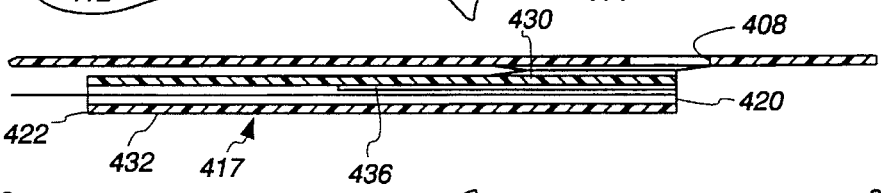
FIG. 34 is a fragmentary cross-sectional view taken along the line 34—34 of FIG. 33.

Turning now to FIG. 33, the underneath surface of upper balloon film 402 is indicated at 410. A valve 412 is "tacked" or lightly secured to film layer 402 by heat sealing 414 in a manner illustrated in FIG. 33. Other techniques of joining valve 412 to layer 402 can also be employed. Valve 412 is of conventional construction, and preferably is identical to valve 50 as described above. As such, valve 412 has sealed edges 418, an inlet end 420 and an outlet end 422. As can be seen in FIG. 34, the inlet end 420 of the preferred valve 412 has top and bottom valve layers 430, 432 with so-called "coterminous" edges. A sealing-preventing barrier layer 436, and the inlet end 420 of the valve, lie directly underneath the hole 408, and in the preferred embodiment, lie generally along a diameter of the circular hole. As mentioned, hole 408 can have different shapes, and it is preferred that the inlet end of the valve, and at least the inlet end of the upper valve layer 430, be spaced from the edge of the hole remote from the balloon film body portion 404, so as to form a hole or other type of opening 438 in the assembly, as illustrated in FIG. 33.

Figure 35:
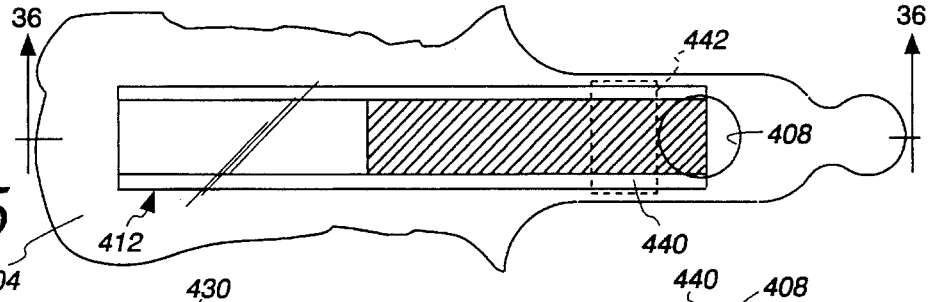
FIG. 35 is a fragmentary bottom plan view similar to that of FIG. 33 but showing an alternative means of connecting the valve to the valve film.

The tack seals 414, illustrated in FIG. 33, are of relatively small size, and, therefore, must be accurately positioned with respect to the valve 412. An alternative tack seal 440 is indicated in FIG. 35, with the dash line 442 indicating the outer perimeter of the heat-sealing die. Accordingly, the upper surface of upper valve layer 430 lying within dash line 442 is joined to the upper balloon layer 402. The preferred technique of tack sealing the valve to the adjacent balloon film is to apply heat solely from the top side of the upper balloon film 402, with heat being transferred to the upper valve film.

Figure 36:
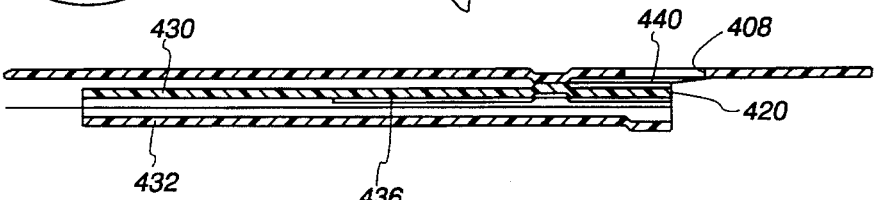
FIG. 36 is a fragmentary cross-sectional view taken along the line 36—36 of FIG. 35.
Figure 37:
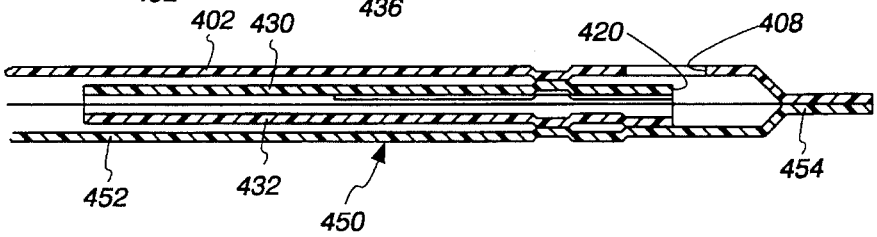
FIG. 37 is a fragmentary cross-sectional view taken along the line 37—37 of FIG. 30.

Referring to FIGS. 35 and 36, a tack seal 440 is illustrated. The tack seal is formed by a sealing die shown in dotted outline at 442. In the preferred mode of construction, the tack seal 440 is made between valve 412 and the upper balloon film layer 404, prior to registration of that partial balloon assembly with the bottom balloon film layer 450. Referring to FIG. 30, the stippled area indicated at 460 is the so-called "balloon seal" formed by sealing dies having the area indicated by the stippling, which apply heat and pressure, sealing together the various balloon and valve film layers. The barrier layer 436, however, is not overcome by either the tack seal 440 of FIG. 35 (or 414 of FIG. 33), or the balloon seal 460. Referring to FIG. 30, when viewed from the top, the balloon assembly 400 includes a semicircular window through which the bottom balloon film 450 can be readily observed. This provides ready visual indication of the inlet edge of the top valve film layer to help a user insert an inflation probe in the inlet valve. As can be seen in FIG. 37, the inlet end of the bottom valve film layer is bonded to the bottom balloon film layer, and thus interference with the inflation probe by the bottom valve film layer is effectively prevented.

Turning now to FIGS. 38–45, an alternative method of construction of balloon assembly 400 is shown. In FIG. 39, the bottom balloon film layer 450 is prepared for a tack seal with valve 412, indicated in FIG. 41. In FIG. 41, the tack seal die 442 is applied to the valve in bottom balloon film layer from above and results in sealing of the bottom valve film layer 432 to the bottom balloon film 450. The tack seal is preferably made continuous across the width of the inlet end of the bottom valve film. FIGS. 43, 44 show the registration of the upper balloon film layer 402, with the same alignment of hole 408 with the inlet end 420 of valve 412, as described in the preceding embodiment.

As can be soon from the above embodiments illustrated in FIGS. 31–45, a pressure vessel is formed from a balloon body having upper and lower balloon films, each balloon film having a body portion defining the pressure vessel and a second, adjoining neck portion. The balloon films are joined together, preferably by heat and pressure, at their periphery to form the pressure vessel. A filling valve is disposed between the neck portions of the balloon films, with an inlet end disposed out of the pressure vessel and an outlet end disposed within the pressure vessel. One of the balloon film neck portions, preferably the upper balloon film, defines an aperture exposing the valve inlet.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A self-sealing valve effective for use in a balloon filled with a pressurized gas, comprising:

first and second layers of flexible heat sealable film valve material disposed in at least partially overlapping relationship, the valve material impermeable to pressurized gas and the first and second layers having inner surfaces which flatten and seal to the other to close the valve;

heat sealing means for heat sealing said first and said second layers together to form a double-ended hollow tube for passage of pressurized gas therethrough, with the tube having an inlet end and an outlet end;

a heat resistant material at the inlet end of the tube, located between the first and second layers, to prevent their heat sealing joinder to one another; and at least one of said first and said second layers having an inlet edge at the inlet end of the tube, with the inlet edge divided into at least two unconnected parts, each with a portion of the free edge, to form a layer with at least two adjacent free edge portions at the inlet end of the tube and forming a valve effective for holding a pressurized gas in a balloon.

2. The valve of claim 1 wherein each said first and said second layers have an inlet end at the inlet end of the tube, the inlet ends of said first and said second layers being coterminous.

3. The valve of claim 1 wherein the two parts are independently movable with respect to each other.

4. The valve of claim 2 wherein the inlet end of one of said layers is divided into two parts by a cut extending along the layer from the inlet edge thereof so as to form adjacent tab portions.

5. The valve of claim 2 wherein the layers are of elongated generally rectangular configuration.

6. The valve of claim 5 wherein the inlet end of one of said layers is divided into two parts by a cut extending from the inlet edge thereof in a longitudinal direction.

7. The valve of claim 6 wherein the two parts are of generally equal size.

8. The valve of claim 2 wherein the cut is made along a line without removing material from the layer.

9. The valve of claim 2 wherein the cut is a notch of removed material.

10. A self-sealing valve effective for use in a balloon filled with a pressurized gas, comprising:

first and second layers of flexible heat sealable film valve material disposed in at least partially overlapping relationship, the valve material impermeable to pressurized gas and the first and second layers having inner surfaces which flatten and seal to the other to close the valve;

heat sealing means for heat sealing said first and said second layers together to form a double-ended hollow tube for passage of pressurized gas therethrough, with the tube having an inlet end and an outlet end;

a heat resistant material at the inlet end of the tube, located between the first and second layers, to prevent their heat sealing joinder to one another; and said first and said second layers having coterminous inlet ends at the inlet end of the tube, with at least one of the inlet ends having an inlet edge divided into at least two unconnected parts, each with a free edge, to forms layer with at least two adjacent free edges at the inlet end of the tube and forming a valve effective for holding a pressurized gas in a balloon.

11. The valve of claim 10 wherein the layers are of elongated generally rectangular configuration.

12. The valve of claim 10 wherein the one inlet end is divided into two parts by a cut line extending from the inlet edge thereof.

13. The valve of claim 12 wherein the two parts are of generally equal size.

14. The valve of claim 12 wherein the cut is made along a line without removing material from the layer.

15. The valve of claim 12 wherein the cut is a notch of removed material.

16. A balloon comprising:

a pair of overlapping balloon film layers joined together so as to form a vessel for containing a pressurized gas;

first and second valve layers of flexible valve material disposed between the balloon film layers in at least partially overlapping relationship;

means for joining said first and said second valve layers together to form a double-ended hollow tubular valve having an inlet end communicating outside the balloon and an outlet end in the vessel interior, for passing pressurized gas to the vessel interior;

said valve layers having free ends at the inlet end of the valve, with at least one free end including a free edge divided into at least two unconnected parts, each with a portion of said free edge, to form a layer with at least two adjacent free edge portions at the inlet end of the valve; and said valve layers being joined to respective balloon film layers adjacent the inlet end of the valve.

17. The balloon of claim 16 wherein said balloon film layers include overlapping body portions defining the cavity and overlapping neck portions extending from the body portions so as to define a tubular neck of smaller size than the balloon cavity, the valve inlet end disposed within the neck; the balloon further including overlapping neck seals extending between the body portion and the neck portion of each balloon film layer, joining the balloon film layers to respective valve layers, with the free ends of the valve layers spaced from the neck seals to form end tabs between the neck seals and the free ends.

18. The balloon of claim 17 wherein the free end of one said valve layer is divided by a cut made along a line from the free edge, without removing material from the layer.

19. The balloon of claim 17 wherein the free end of one said valve layer is divided by a notch of removed material.

20. A balloon comprising:

a pair of overlapping balloon film layers joined together so as to form a vessel for containing a pressurized gas;

first and second valve layers of flexible valve material disposed between the balloon film layers in at least partially overlapping relationship;

means for joining said first and said second valve layers together to form a double-ended hollow tubular valve having an inlet end for communication outside the balloon and an outlet end in the vessel interior, for passing pressurized gas to the vessel interior;

a valve seal joining parts of said valve layers adjacent the inlet end of said valve to respective ones of said balloon film layers; and at least a part of one valve layer free end having a free edge which is divided into at least two unconnected parts, each with a free edge, to form at least two adjacent free edges at the inlet end of the valve.

21. The balloon of claim 20 wherein the valve layers are of elongated generally rectangular configuration, and the valve seal is generally linear, extending generally parallel to the inlet end of the valve.

22. The valve of claim 21 wherein the one valve layer free edge is divided into two parts by a cut extending in a longitudinal direction from the one valve layer free edge, so as to form two side-by-side tab portions.

23. A balloon, comprising:

a balloon body including two overlapping balloon films, each balloon film having a first and second portion;

means for joining first portions of the balloon films together so as to form a pressure vessel;

a filling valve having an inlet end disposed between the second portions of the balloon films outside of the pressure vessel and an outlet end disposed within the pressure vessel;

one of said balloon film second portions defining an aperture exposing the valve inlet end; and the filling valve including a valve film layer having an inlet edge at the inlet end of the filling valve, the inlet edge divided by at least one cut line to form at least two adjacent free edge portions at the inlet end of the filling valve with the at least one end line extending from the free edge portions.

24. The balloon of claim 23 wherein the balloon film second portions define an elongated neck protruding from the pressure vessel, the valve inlet defining an inlet edge extending nonparallel to the longitudinal direction of the neck, and the aperture surrounding the inlet edge so as to expose portions of the other of said balloon film second portions.

25. The balloon of claim 23 wherein the filling valve comprises first and second overlapping valve films, the first valve film immediately adjacent said one balloon film, and the second valve film immediately adjacent the other of said balloon films, with the second valve film having portions thereof at the inlet end of the valve bonded to the second balloon film.

26. The balloons of claim 25 wherein the first balloon film is joined to portions of said first valve film at points remote from said first portion of said balloon film.

27. The balloon of claim 25 wherein the first balloon film aperture is circular.

* * * * *

UNITED STATES PATENT AND TRADEMARK OFFICE

CERTIFICATE OF CORRECTION

PATENT NO. : 5,595,521

DATED : January 21, 1997

INVENTOR(S) : Charles R. Becker

It is certified that error appears in the above-indentified patent and that said Letters Patent is hereby corrected as shown below:

Column 10, line 14, change "forms" to -- form a --.

Signed and Sealed this

Twenty-third Day of September, 1997

*Attest:*

*Attesting Officer*

Bruce Lehman

BRUCE LEHMAN

*Commissioner of Patents and Trademarks*